US007089853B1

(12) United States Patent
Diekleman

(10) Patent No.: US 7,089,853 B1
(45) Date of Patent: Aug. 15, 2006

(54) PORTABLE TRASH COMPACTOR

(76) Inventor: Kenneth Diekleman, 1928 Thunderbird Pl., Anchorage, AK (US) 99508

( * ) Notice: Subject to any disclaimer, the term of this patent is extended or adjusted under 35 U.S.C. 154(b) by 208 days.

(21) Appl. No.: 10/654,285

(22) Filed: Sep. 2, 2003

Related U.S. Application Data

(63) Continuation-in-part of application No. 10/102,155, filed on Mar. 19, 2002, now abandoned.

(51) Int. Cl.
*B30B 15/04* (2006.01)
*B65B 1/24* (2006.01)
*B30B 12/00* (2006.01)

(52) U.S. Cl. ..... 100/229 A; 100/56; 100/57; 100/59; 100/245; 100/247

(58) Field of Classification Search ..... 100/54, 100/56–59, 61, 126, 127, 230, 246, 247, 100/295, 902, 240, 245, 213, 214, 229 R, 100/229 A; 241/68
See application file for complete search history.

(56) References Cited

U.S. PATENT DOCUMENTS 354,022 A * 12/1886 Onderdonk ..... 100/213
3,567,085 A * 3/1971 Flores ..... 224/604
4,554,868 A * 11/1985 Zimmer ..... 100/229 R
4,658,720 A * 4/1987 Massonnet ..... 100/226
5,080,011 A * 1/1992 Paxton et al. ..... 100/229 A
5,090,309 A * 2/1992 Lai ..... 100/226
5,637,817 A * 6/1997 Sherman ..... 84/313
5,658,608 A * 8/1997 Klefbeck ..... 426/512
5,746,126 A * 5/1998 Huang ..... 100/125

FOREIGN PATENT DOCUMENTS

GB 2232635 * 12/1990

* cited by examiner

*Primary Examiner*—Derris H. Banks
*Assistant Examiner*—Shelley Self
(74) *Attorney, Agent, or Firm*—Michael Tavella

(57) ABSTRACT

A trash compactor suitable for backpacking having two parts: a container and a removable plunger. The container is made from a tube. The ends of the tube are formed to accept caps. The caps are fitted with gaskets to prevent leaking of liquids and odors. One of the end caps has a plug to allow liquids to be drained from the container during compression. In one embodiment, the plunger has a flat press end and a handle. In another embodiment, the plunger base is fitted into one of the screw caps. The handle is a threaded shaft that screws into the plunger base. The container may be lined with a plastic bag for disposal or the trash can be stored in the container and then transferred to a separate plastic bag for disposal. The compactor can be used in recreational vehicles, boats and automobiles as well as by hikers.

14 Claims, 13 Drawing Sheets

PORTABLE TRASH COMPACTOR

CROSS REFERENCE TO RELATED APPLICATIONS

This is a continuation-in-part of application Ser. No. 10/102,155, filed Mar. 19, 2002, now abandoned.

STATEMENT REGARDING FEDERALLY SPONSORED RESEARCH AND DEVELOPMENT

Not Applicable

BACKGROUND OF THE INVENTION

1. Field of the Invention

This invention relates to portable trash compactors and particularly to portable trash compactors for backpacking use.

2. Description of the Prior Art

Backpacking in remote areas of the country has long been a popular outdoor activity. When backpacking, people carry everything they need for backcountry living with them. This includes shelter, food and water. In many cases, backpacking is a pleasant experience. However, like home living, there are some inconveniences. In the backcountry, there are usually no trash receptacles. The standard rule is "if you pack it in, you must pack it out." Although backpackers do travel light, they can produce a bulky amount of trash. This is often inconvenient to carry as the amount of trash increases as the hike continues. Plastic trash bags serve as a useful way to hold trash, but they can be damaged. This can cause undesirable problems, such as trash being dumped on a trail or liquids to leaking out into a backpack.

Two devices that deal with trash storage in outdoor locations are found in U.S. patents. U.S. Pat. No. 5,344,109 to Hokoana Jr. discloses a frame that can be suspended. The frame holds a plastic trash bag, which can be suspended by a hook on the frame. A cover can also be used to cover the trash within the bag. Although this device is designed for home and garden use, it can be used by backpackers to hold trash. The problem is that the backpacker is then left with a large plastic bag full of trash to carry out, with all of the problems mentioned above.

U.S. Pat. No. 4,280,643 to Cordova teaches a camping clean up station that includes a water jug, cups a towel and a small disposable trash container. The problem is here that the trash container is again, a small plastic bag that simply holds trash.

It has long been recognized that compacting trash is an efficient way to store and hold large amounts of trash. Compactors compress trash down to a small volume compared to uncompacted trash. This small volume is then easier to carry and store until it can be disposed of. Electric trash compactors have been used in homes for years. Unfortunately, they cannot be used in the wilds.

Manual trash compactors have been developed, but these are generally for large trashcans and are not practical for backpacking applications. Some examples of these devices are found in the following U.S. patents: U.S. Pat. No. 3,438,322 to Marasco teaches a compactor that has a large frame. A trash receptacle is placed within the frame. A large lid that fits within the receptacle is suspended from a pivoting arm. After trash is placed in the container, the lid is dropped down into the container and the arm is depressed. This causes the lid to compress the trash that is in the container. Once compressed, the lid can be withdrawn for additional trash loads until the container is full.

U.S. Pat. No. 5,220,866 teaches a stacked trash container system. In this design, an outer container holds the trash. The outer container has pleated sides that can be compressed. An inner container, or alternatively, a plunger, is placed within the outer container on top of the trash. The inner container is then pushed down, compressing the pleats until the trash in the outer container is fully compressed. This step can be repeated until the container is full.

U.S. Pat. No. 3,919,932 to Basuino is similar to the Marasco patent in that it uses a lid attached to a lever to compress trash in a container. Unlike Marasco, the lid and arm assembly is mounted to a wall and the large frame is eliminated. The device can be folded to sit against the wall and then pulled out when needed. As before, the lid is placed into the container and the arm is used to press down on the trash.

U.S. Pat. No. 5,730,047 teaches a portable container that has a pivoting lid. An arm is attached to the lid so that when the lid is placed in the container, the arm can be used to compress the trash within the container.

U.S. Pat. No. 5,746,126 teaches an interesting form of compactor. This unit is intended to be bolted to a table or bench, so it is not suitable for portable use. It has an upper chamber and a lower chamber that are separated by a grate. The upper chamber is sealed and has an access door for loading trash. The device has a double plunger system. It has a first plunger that is a screw type plunger. This is operated by a wheel that is turned. This plunger is a hollow tube. Within this tube is a second plunger. This plunger is an impact type that is operated by raising and lower the plunger, thus pounding the refuse down. The impact plunger is designed to be used initially. Once the refuse has been pounded, the wheel can be turned to further compress the refuse down. Once compressed, the grate at the bottom of the container is removed and the trash is allowed to fall into the lower container. This container is removable for disposal of the compacted trash.

Finally, U.S. Pat. No. 5,845,567 discloses a trash compactor that uses a small container to hold trash. A hinged lid is used to close the box. The lid is attached to a vertical slide. The slide is pushed down to compress the trash within the container. Once the trash is compressed, it can be removed from the container and be disposed of in a standard container. While useful, none of these devices is suitable for backpacking applications in remote areas.

BRIEF DESCRIPTION OF THE INVENTION

The instant invention is suitable for backpacking. It consists of two parts. First is a container and the second is a removable plunger. The container is made from a plastic tube. The ends of the tube are formed to accept caps. The caps are fitted with gaskets to prevent leaking of liquids and odors. One of the end caps has a plug to allow liquids to be drained from the container during compression.

The plunger can have different configurations. In one embodiment, the plunger has a flat press end and a handle extending out from it. In another embodiment, the plunger base is fitted into one of the screw caps. The handle is a threaded shaft that screws into the plunger base.

The container is lined with a plastic bag before use to collect the compressed trash. In one embodiment, the trash can be stored in the container and then transferred to a separate plastic bag for disposal.

In another embodiment, the plunger is eliminated. The tube is formed with a set of very coarse threads on one half of its inner wall. One end cap is formed that has a set of corresponding threads on its outer surface. Thus, this end cap screws down into the tube. A wrench is used to turn the end cap down. A sealing end cap is placed on the other end of the tube to close it off. Refuse is placed in the tube and the first end cap is screwed down into the tube. As this cap is screwed down, it compresses the trash in the tube. As additional trash is placed in the tube, the end cap can be backed out and screwed back in to compress this additional trash. This produces a compact device that has a minimum of parts.

The compactor can be used in recreational vehicles, boats and automobiles as well as by hikers.

It is an object of this invention to produce a portable trash compactor for use while backpacking.

It is another object of this invention to produce a portable trash compactor that can be used to conveniently compact trash in remote areas for subsequent disposal.

It is yet another object of the invention to produce a portable trash compactor that allows liquids to be drained during compaction.

It is yet another object of the invention to produce a portable trash compactor that has a variety of compression plungers for compressing the trash.

It is yet another object of the invention to produce a portable trash compactor that has sealed end caps that are air and water tight to prevent leaking.

DETAILED DESCRIPTION OF THE INVENTION

Figure 1:
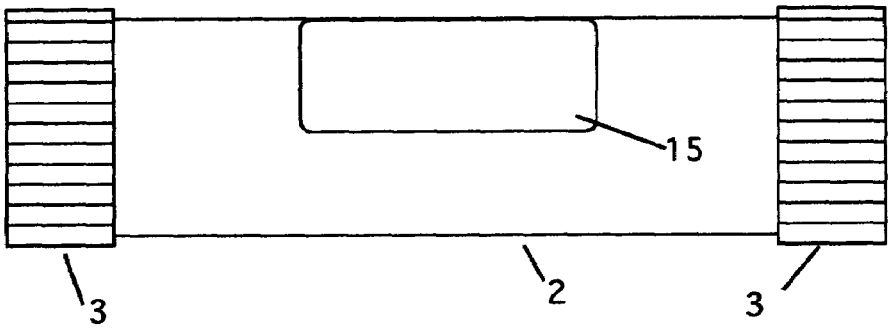
FIG. 1 is a side view of the invention showing a removable plunger.
Figure 1A:
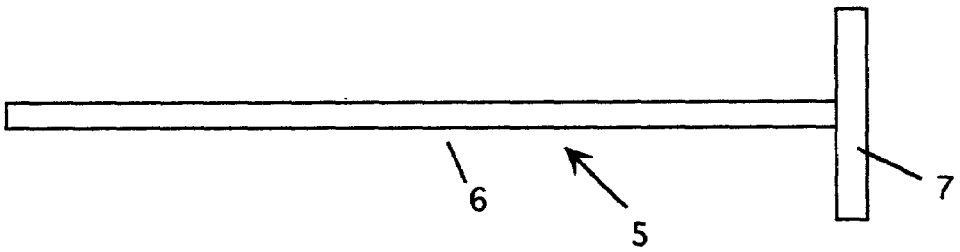
FIG. 1*a* is a side view of a removable plunger.
Figure 2B:
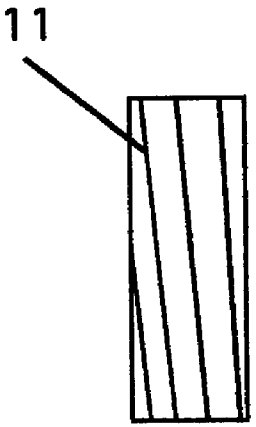
FIG. 2*b* is a side view of a threaded end cap.
Figure 2C:
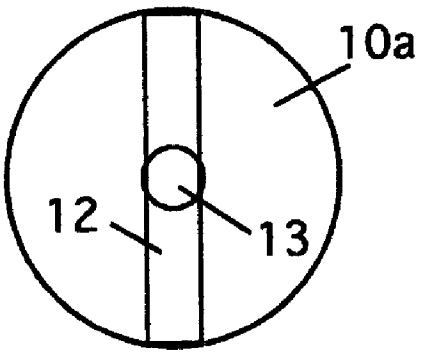
FIG. 2*c* is a top view of the second of two end caps.
Figure 2A:
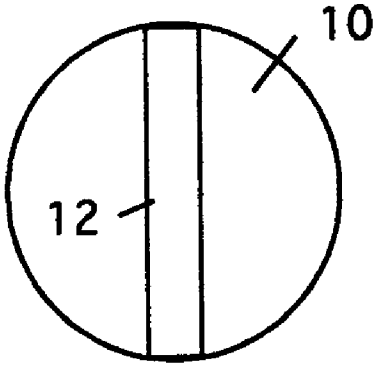
FIG. 2*a* is a top view of two end caps.

Referring now to FIGS. 1 and 1*a*, the basic form of the invention 1 is shown. In this embodiment, the device has a main tube 2 and two threaded ends 3, which act as a housing. In this embodiment, the ends have threads 3*a* on the inside to accept caps 10 and 10*a* as described below. A plunger 5 is used to compact trash placed inside the tube 2 (see FIG. 1*a*). As shown in FIGS. 2*a*, 2*b*, and 2*c*, in this embodiment, two end caps 10 and 10*a* are used. Both caps have external threads 11 that mate with the threads in the threaded ends 3. Both caps have center ridges 12 that allow the user to turn the caps to lock then in place. Cap 10*a* also has a center hole 13 that accepts the handle 6 of the plunger 5. To use this embodiment, seal one end of the tube 2 with cap 10. Then place cap 10*a* over the handle 6 of the plunger. Insert the paddle part 7 of the plunger into the tube and secure cap 10*a* in place. Push on the plunger handle to compact the trash in the tube. The user can use a rock, hammer or similar tool to help push the plunger into the tube to further compress the trash. When the tube is full, cap 10 can be removed and the plunger can then be used to push the compressed trash out of the tube and into a proper receptacle, such as a plastic trash bag.

FIG. 1 also shows an option for a side door 15 that can be used to load the container without having to remove the end caps.

Figure 3A:
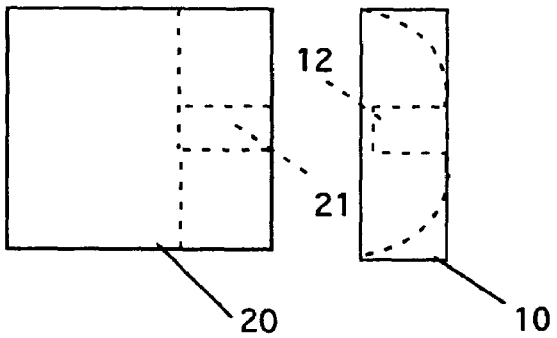
FIG. 3*a* is a detail view of a wrench used to remove the end caps and an end cap.
Figure 3B:
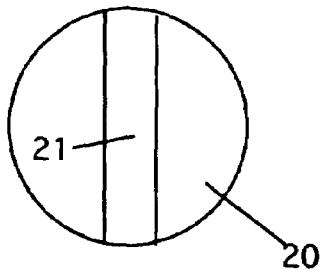
FIG. 3*b* is an end view of the wrench.

FIGS. 3*a* and 3*b* show a wrench 20 that can be used to help screw in the screw-type end caps 10 and 10*a*. The wrench is a cylinder that is similar in size to the caps. The wrench has a center void 21 that mates with the center ridge 12 in the caps. Once the wrench is in place, it makes turning the end caps easy. Of course, the wrench can have a ridge and the end caps can have a central void. The choice is a matter of design.

Figure 4:
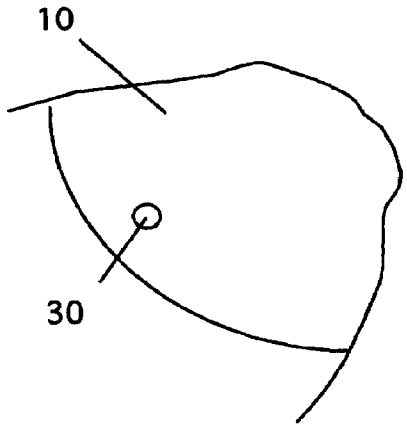
FIG. 4 is a detail view of a bleeder valve on the device.

FIG. 4 shows details of a bleeder valve 30. Although the bleeder valve 30 can be placed in the tube, the preferred location is to place it in end cap 10. This valve is designed to pass liquids that are in the tube when the trash is being compressed. If there is no compression, the valve is closed to prevent leaks.

Figure 5:
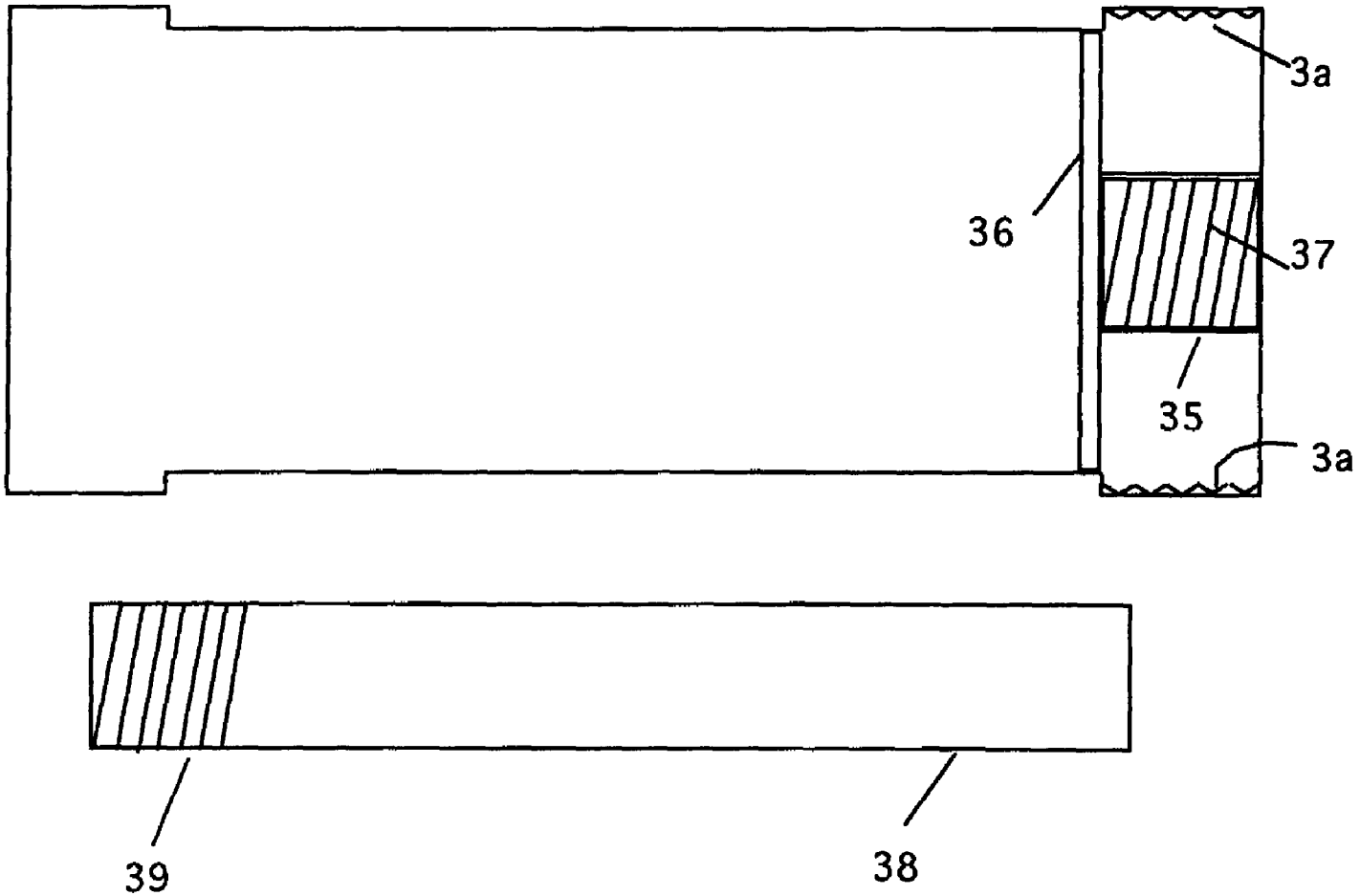
FIG. 5 is a cross-sectional view of a second embodiment of the device having a threaded plunger system.

FIG. 5 shows yet another embodiment. In this embodiment, end cap 10*a* has a center hole as before. However, this hole forms a cylinder 35. A plunger base 36 has an upper cylinder 37 that has internal threads. Cylinder 37 is designed to be friction fit into cylinder 35. The plunger handle 38 has a set of corresponding threads 39 that match the threads in the cylinder 37. In this way, the plunger base 36 is designed to remain in the tube, fitted into the end cap. The handle is then removable to store separately.

Figure 6:
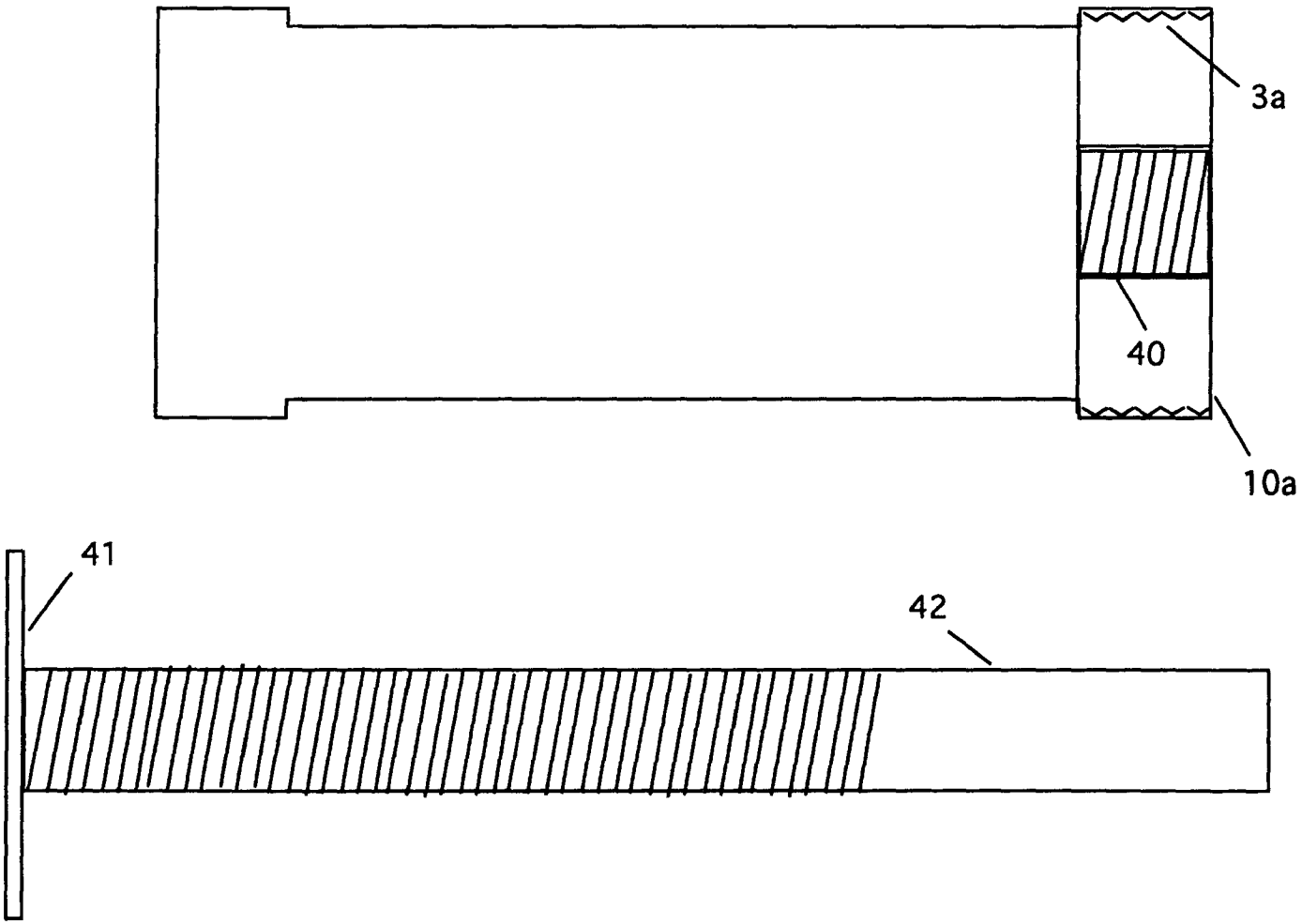
FIG. 6 is an alternative form of the second embodiment.

FIG. 6 is a variation of this design. Here, end cap 10*a* has a threaded cylinder 40. The plunger has a flat end 41 and a threaded shaft 42. In this embodiment, the plunger is made a permanent part of the end cap 10*a*. The threaded handle is screwed into the threaded cylinder 40 and then the flat end 41 is attached so that when the end cap is installed in the tube, the flat end is inside. In this embodiment, trash is placed inside the tube. End cap 10*a* is screwed in place. Then the handle 42 is turned, which forces the flat portion of the plunger to compress the trash. The handle can be unscrewed as desired to load more trash for compacting.

Figure 7:
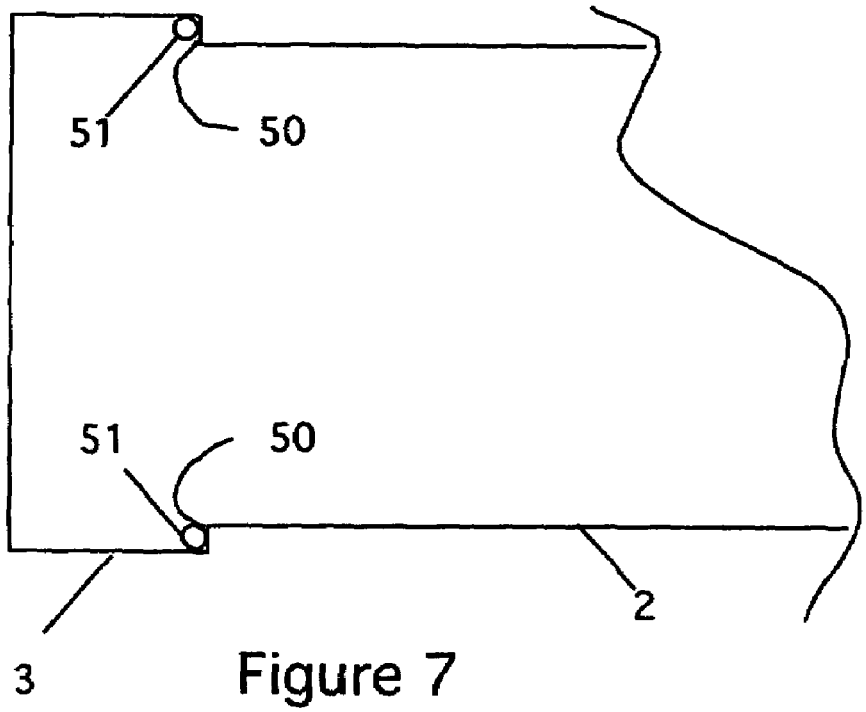
FIG. 7 is a detail of an o-ring type seal for the end caps.

FIG. 7 shows an important feature of the device. FIG. 7 shows a cross-section of the basic embodiment without the end cap in place. Inside the end portion 3 is a small ridge 50. On this ridge is placed an o-ring type seal 51. The o-ring seal prevents leakage from the device. Note that a seal is provided for in each end of the device. Note also that the seal can be any type of seal known in the art and can be adapted to different types of end caps.

Figure 8:
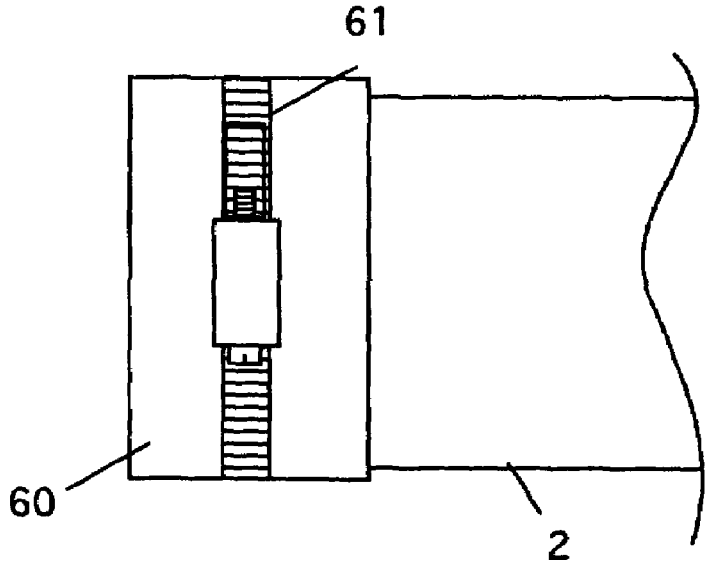
FIG. 8 is a detail view of a different means to secure the end caps in place.

As just mentioned, the device can have different styles of end caps. For example, the tube 2 can have external threaded ends that accept caps that fit over m instead of into, the ends of the tube. In this case, the seal is placed in the end cap and not in the tube. Moreover, the end caps do not have to be threaded. They can be slip fit, friction fit and held with pipe clamps. FIG. 8 shows an end cap 60 fitted to tube 2 with a threaded pipe clamp 61. These methods are not preferred, however, because it is not as easy to obtain a reliable seal with these methods so that the seal remains in place during compaction of the trash.

Figure 9:
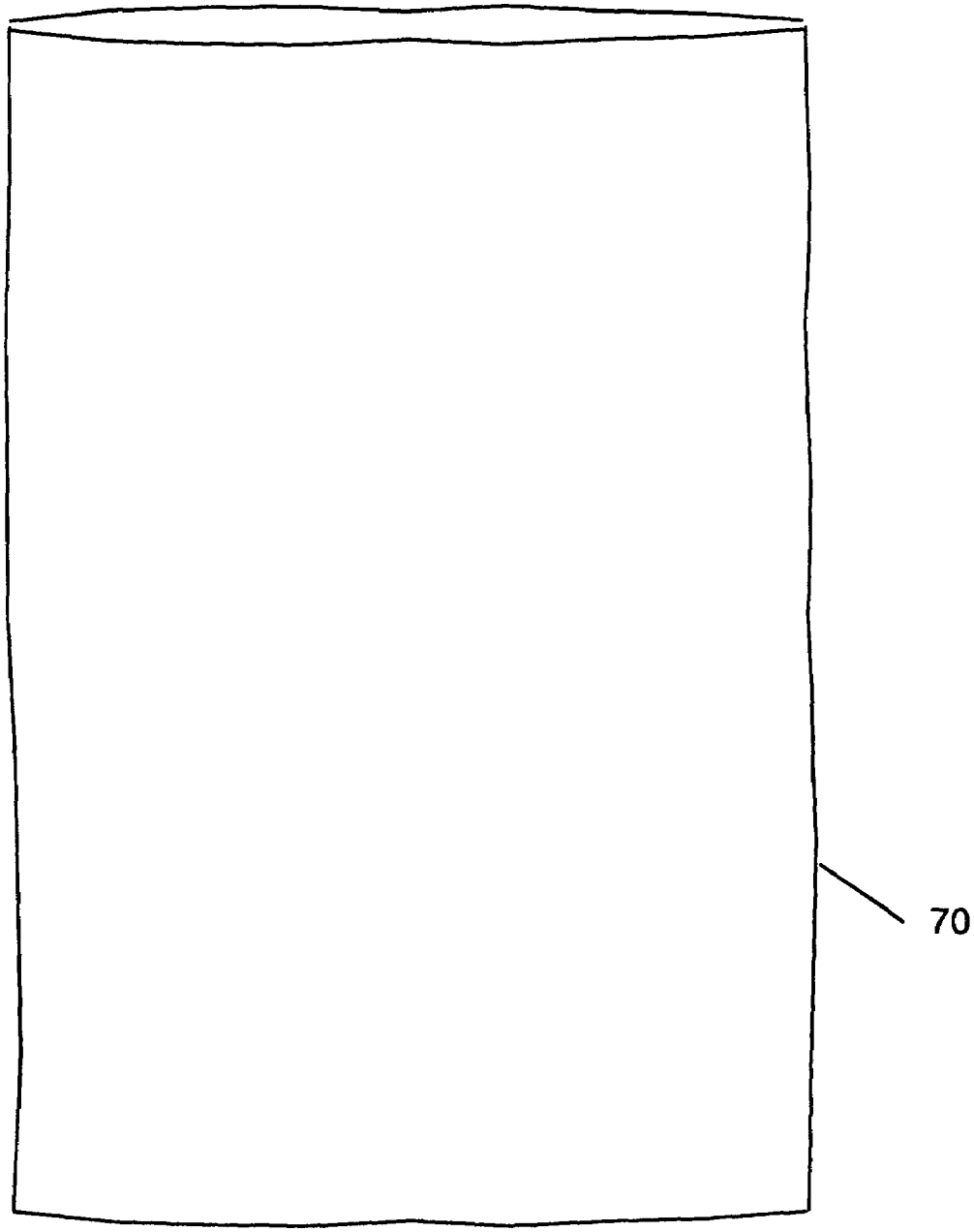
FIG. 9 is a side view of a removable plastic liner for the device.

FIG. 9 shows a liner 70. The liner is plastic and is shaped to fit the inside of the tube. Using a liner eliminates the need to place the compacted trash into a separate receptacle for disposal. When fully loaded, the bag 70 can be sealed and pulled from the tube for disposal without any further steps. Note that for the container with the optional side door 15, the bag cannot be used as shown.

The device can be made from any suitable material such as cardboard, metal, wood or plastic. Because the device is designed for backpacking use, lightweight materials such as plastics are preferred. A cardboard device may be used as a disposable model. When full, the tube can simply be thrown away, without having to empty it. Of course, the plunger would have to be sufficiently strong to ensure good compaction in this case.

Figure 10:
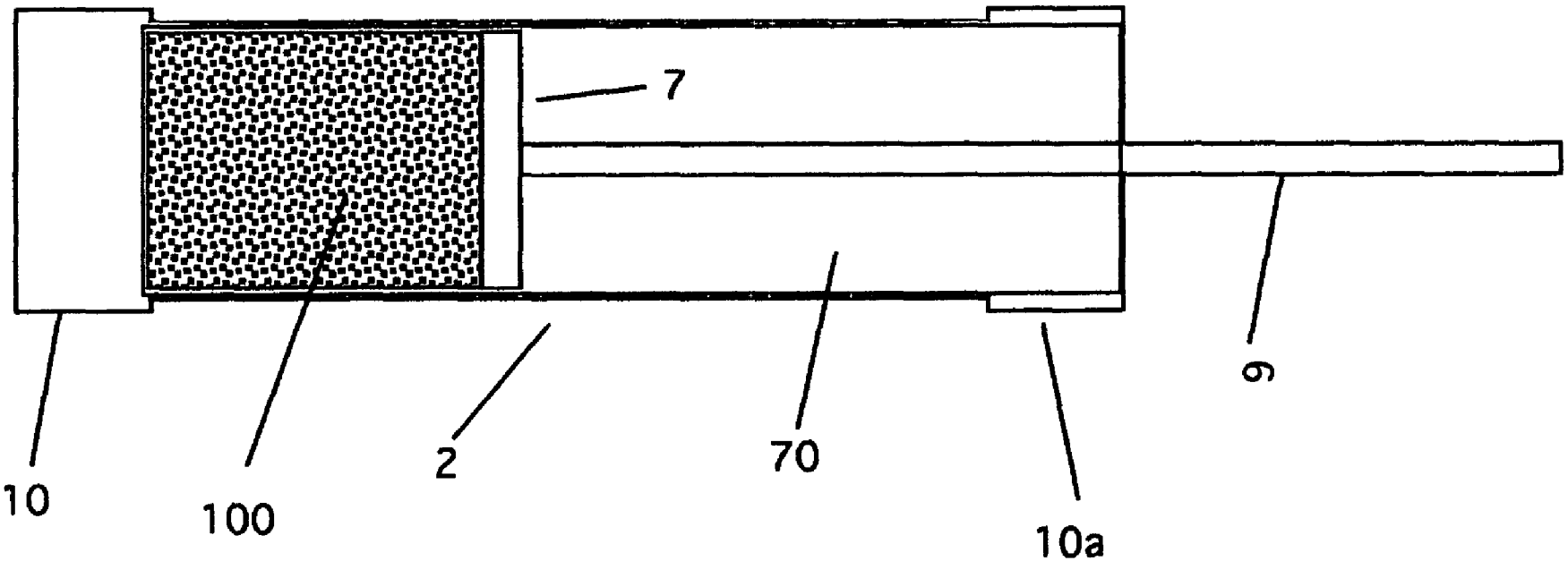
FIG. 10 is a side view of one embodiment of the invention as assembled, showing a removable liner installed in the housing, with the plunger in place and a quantity of compacted refuse being held in the container.

FIG. 10 shows a side view of one embodiment of the invention as assembled, showing a removable liner 70 installed in the housing 2, with the two end caps 10 and 10*a* in place, with the plunger 5 compressing a quantity of compacted refuse 100 being held in the container.

Figure 11:
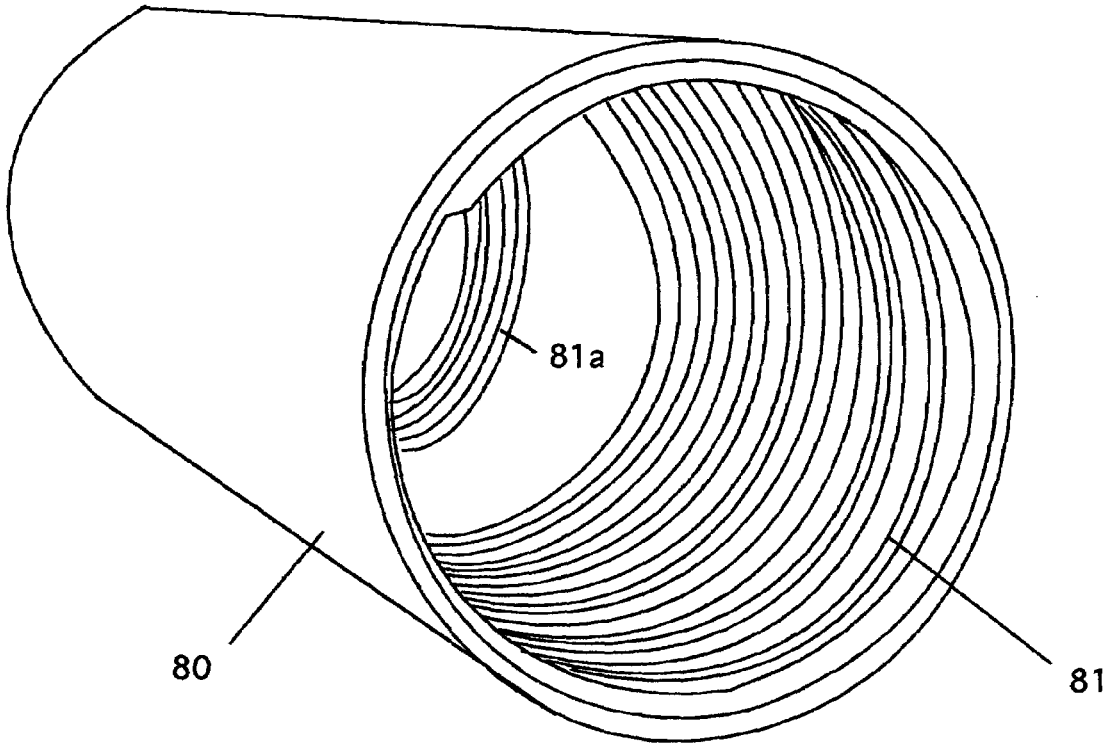
FIG. 11 is a perspective view of the tube of a third embodiment.

FIG. 11 is a perspective view of the tube of a third embodiment. In this embodiment, there is no separate plunger or piston to compress the trash. Rather, one of the end caps is used to compress the trash. As shown in FIG. 11, the tube 80 has two open ends as before. In the preferred embodiment, one end has a set of square threads 81. Note that these threads are quite large, being approximately ⅛ inch (3 mm) wide. This enables the cap to be screwed down into the tube, as discussed below to compress the trash without causing the threads to be stripped or jammed. FIG. 11 also shows a number of fine threads 81*a* at the other end of the tube. These threads mate with the threads on the second end cap (discussed below).

Figure 12:
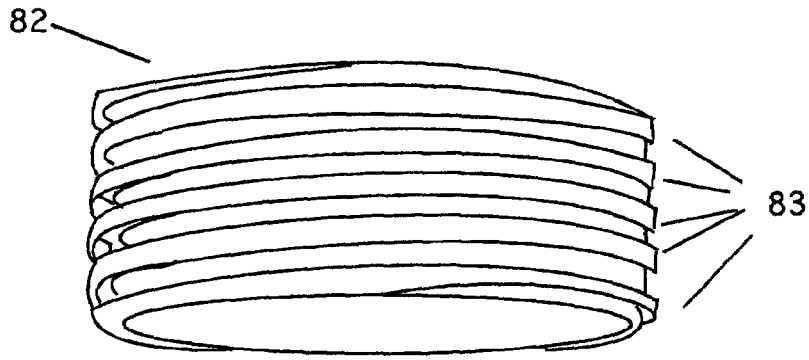
FIG. 12 is a side view of the end cap-compressor of the third embodiment.

FIG. 12 is a side view of the end cap-compressor 82 of the third embodiment. As shown, the end cap-compressor 82 has a set of corresponding square threads 83 that mate with the threads in the tube. Of course, other types of coarse threads may be used in place of the square threads discussed above.

Figure 13:
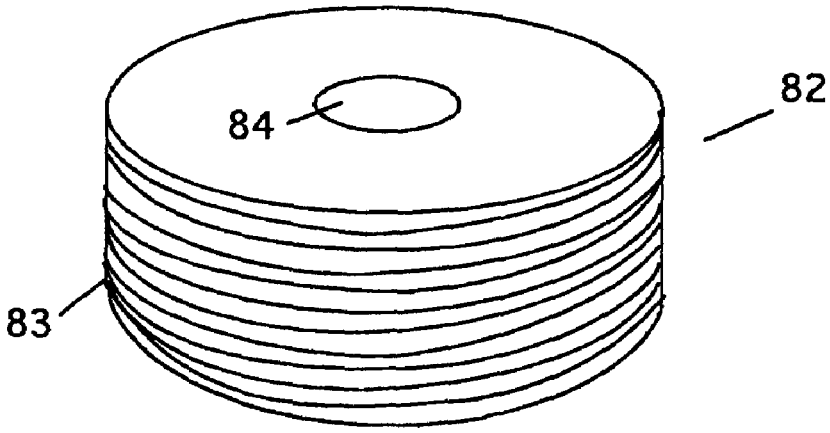
FIG. 13 is a perspective view of the end-cap compressor of the third embodiment.
Figure 14:
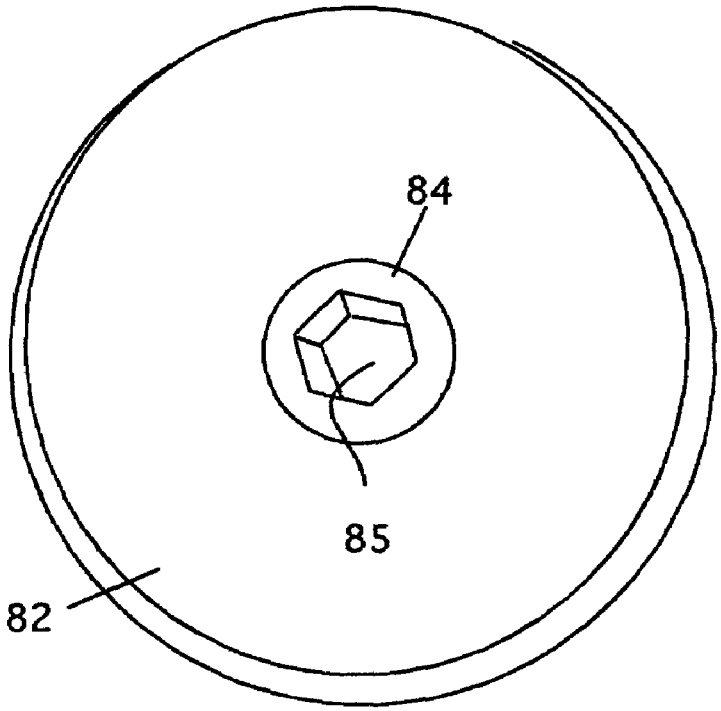
FIG. 14 is a top plan view of the end-cap compressor of the third embodiment.

FIG. 13 is a perspective view of the end-cap compressor 82 of the third embodiment. FIG. 14 is a top plan view of the end-cap compressor 82 of the third embodiment. These views show a center insert 84 that has a hex shaped receptacle 85 formed therein. This receptacle 85 accepts a hex drive that is used to turn the end cap-compressor into (and out of) the container 80. Of course, while the hex key is preferred, any other suitably shaped drive may be used instead. Hex drives are commonly used in hex key wrench sets and are easy to obtain and use.

Figure 18:
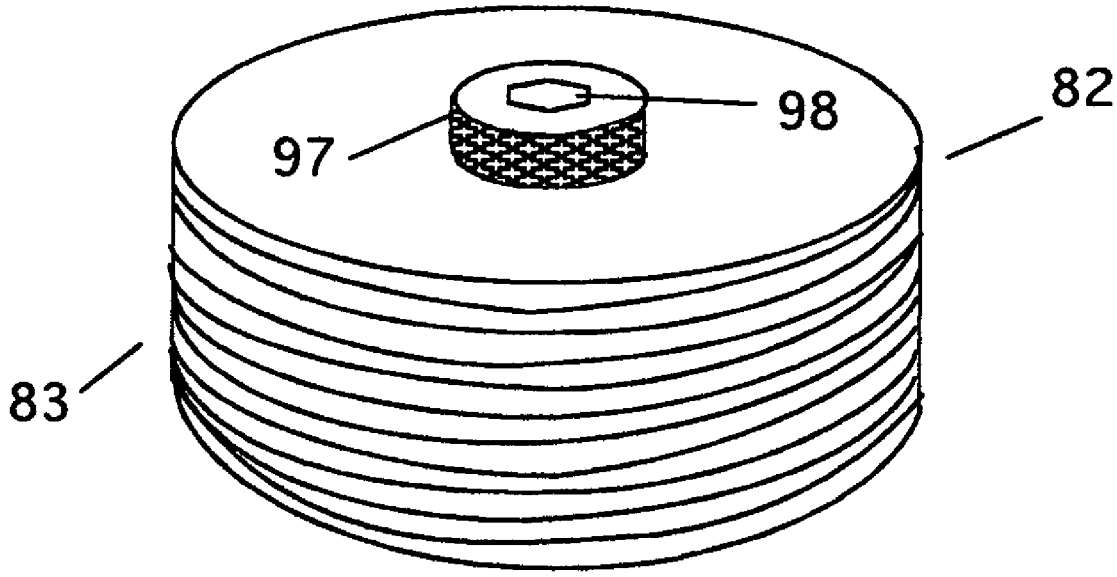
FIG. 18 is a perspective view of the end-cap compressor of the third embodiment showing an alternative threading handle.

FIG. 18 is a perspective view of the end-cap compressor of the third embodiment. Here, instead of a recessed center insert, a knurled knob 97 is shown. This knob is formed on the top of the cap to allow the user to turn the cap into the housing without the use of tools. The knob 97 also has a hex insert 98 as shown. This allows the use of a tool as well.

Figure 15:
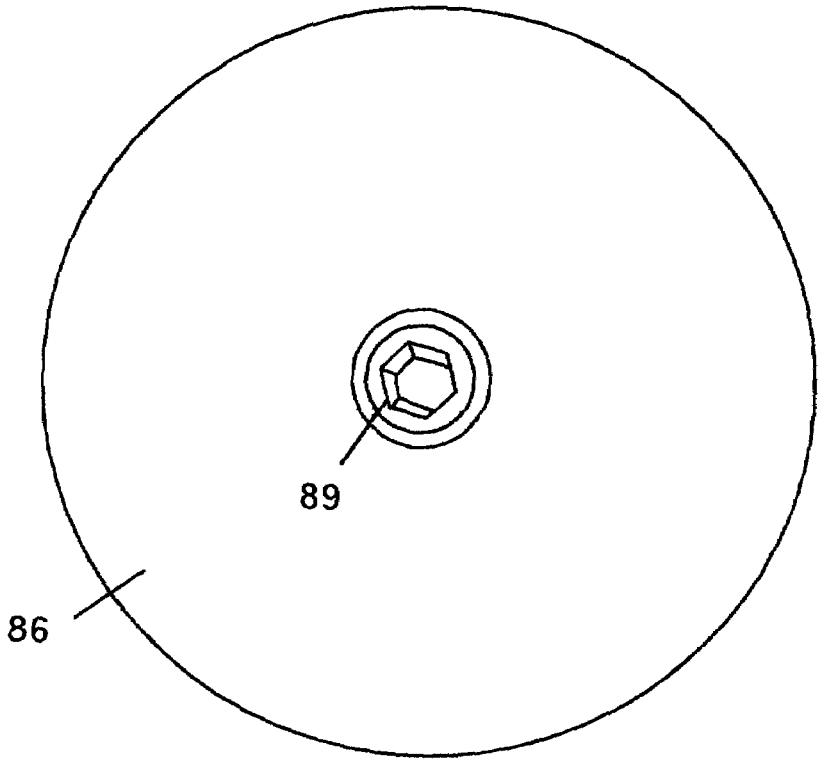
FIG. 15 is a top plan view of the second end cap of the third embodiment.
Figure 16:
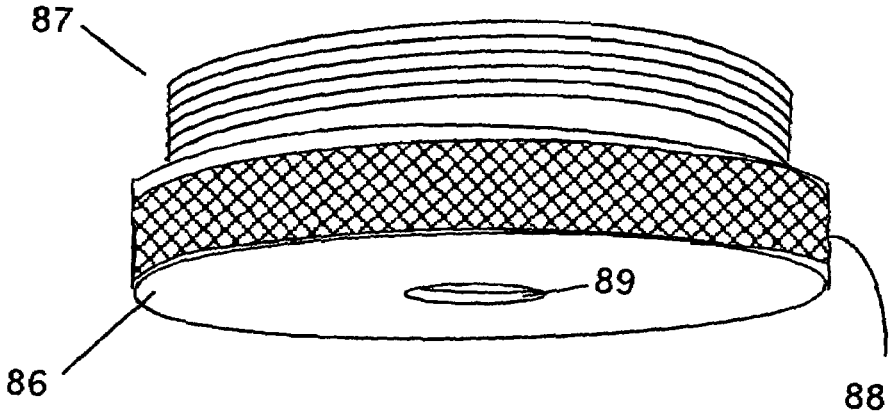
FIG. 16 is a side perspective view of the second end cap of the third embodiment.

FIGS. 15 and 16 show a top plan view of the second end cap 86 of the third embodiment and a side perspective view of the second end cap of the third embodiment respectively. Here, the end cap 86 has fine threads 87. These threads mate with the fine threads 81*a* shown in FIG. 11. Note also that the end cap 86 has a wide flange 88 at its base. This is to provide a gasket seal for the tube.

As shown in FIG. 15, a hex head threaded boss 89 is installed into the end cap 86. This boss 89 may be removed to drain any liquid that may accumulate within the tube during the compressing operation.

Figure 17:
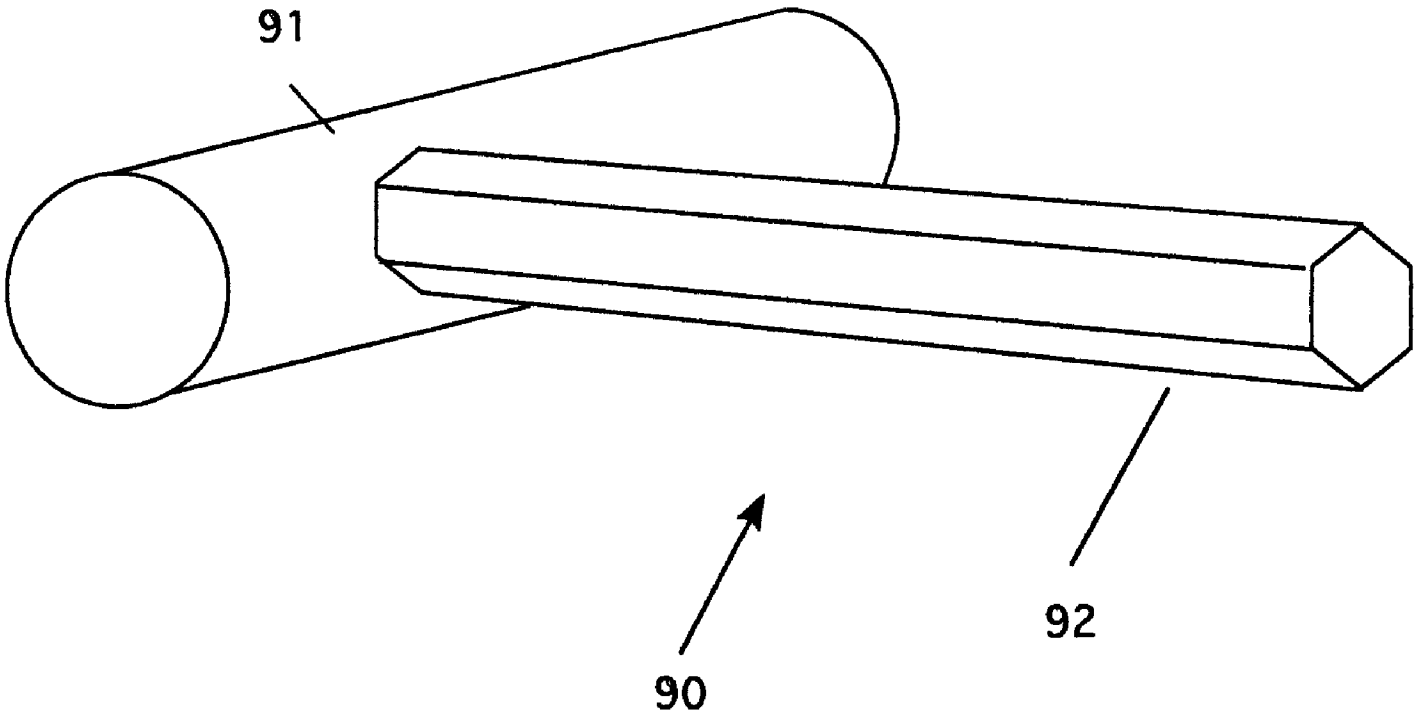
FIG. 17 is a perspective view of an operating tool for the third embodiment.

FIG. 17 is a perspective view of an operating tool 90 for the third embodiment. It has a handle 91 and a shaft 92. Note that the shaft shown is hexagonal, which matches the hex shaped receptacle 85. Of course, as mentioned before, the tool shaft and receptacle can be made using other shapes as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A portable trash compactor comprising:

a) a housing having a hollow interior, a first end and a second end;

b) a first end cap, having a set of internal threads, removably installed on the first end;

c) a means for sealing said first end cap on said first end;

d) a plunger, having a flat plate portion and a handle, whereby the flat plate portion of said plunger is removably inserted into said housing such that said handle extends upward from the second end;

e) a second end cap, having a set of internal threads, said second end cap having a hole formed therein, said second end cap being removably attached to the second end of said housing such that the handle of said plunger passes through the hole formed in said second end cap; and f) a removable liner installed in said housing.

2. The portable trash compactor of claim 1 wherein the first and second end caps have a set of external threads.

3. The portable trash compactor of claim 1 wherein the removable liner is a plastic bag.

4. The portable trash compactor of claim 1 wherein the housing and, first and second end caps are made of a material selected from the group of: wood, plastic, or metal.

5. A portable trash compactor comprising:

a) a housing having a hollow interior, a first end and a second end;

b) a first end cap, having a set of internal threads, removably installed on the first end;

c) a means for sealing said first end cap on said first end;

d) a second end cap, having a set of internal threads, said second end cap having a hole in said end cap, and further having a hollow cylindrical tube formed thereon, and aligned with said hole, said hollow cylindrical tube having a set of internal threads formed therein;

e) a plunger having a flat plate and a handle, said handle extending upward and orthogonal to said flat plate, said handle a set of threads formed thereon, wherein said set of threads corresponds to the set of threads in said hollow cylindrical tube;

f) wherein said plunger is assembled to said second end cap such that said handle is threaded into said hollow cylindrical tube and said plunger is installed such that when said second end cap is placed on said second end of said housing, said flat portion is inside said housing, and further wherein when said handle is turned, said flat plate is raised or lowered within said housing; and g) a removable liner, installed in said housing.

6. The portable trash compactor of claim 5 wherein the first and second end caps have a set of external threads.

7. The portable trash compactor of claim 5 wherein the removable liner is a plastic bag.

8. The portable trash compactor of claim 5 wherein the housing and, first and second end caps are made of a material selected from the group of: wood, plastic, or metal.

9. A portable trash compactor comprising:

a) a cylindrical housing having a first end, a second end and a length, wherein said first end of said cylindrical housing having a plurality of course threads formed therein and further wherein said plurality of coarse threads extends into said cylindrical housing about half the length of said cylindrical housing;

b) a first end cap, having a length and an outer cylindrical surface, a plurality of coarse threads formed on the entire length of said outer cylindrical surface, such that said coarse threads on said first end cap mesh with the coarse threads in said first end of said cylindrical housing and further such that the entire length of said first end cap can penetrate into said cylindrical housing;

b) a means for turning said first end cap when said first end cap is installed in said cylindrical housing;

c) a second end cap; and d) a means for removably attaching said second end cap on said second end of said cylindrical housing.

10. The portable trash compactor of claim 9 wherein the means for removably attaching said second end cap comprise a plurality of fine threads, formed in said second end of said cylindrical housing; and a corresponding set of fine threads formed on said second end cap.

11. The portable trash compactor of claim 9 wherein the means for turning said first end cap comprise a receptacle formed in said first end cap; and a mating tool formed to mate with said receptacle.

12. The portable trash compactor of claim 9 wherein the means for turning said first end cap comprises a knob, fixedly attached to the said first end cap and extending upwardly therefrom.

13. The portable trash compactor of claim 9 wherein said second end cap has a means for draining liquids from said cylindrical housing.

14. The portable trash compactor of claim 13 wherein the means for draining liquids comprises a threaded boss removably installed in said second end cap.

* * * * *